United States Patent [19]

Worrell

[11] 4,132,372

[45] Jan. 2, 1979

[54] CABLE HOLDER AND DISPENSER

[76] Inventor: Milton H. Worrell, N. Main St., Vincentown, N.J. 08088

[21] Appl. No.: 877,261

[22] Filed: Feb. 13, 1978

[51] Int. Cl.[2] ..... B65H 49/00

[52] U.S. Cl. ..... 242/129.62; 242/134

[58] Field of Search ..... 242/129.5–129.62, 242/134, 139, 141; 248/216.1, 216.3, 214

[56] References Cited

U.S. PATENT DOCUMENTS

| | | | |
|---|---|---|---|
| 1,378,752 | 5/1921 | Wright | 242/129.62 |
| 3,383,071 | 5/1968 | Godson | 242/129.6 |
| 3,411,735 | 11/1968 | Hurd | 242/129.62 |

*Primary Examiner*—Leonard D. Christian
*Attorney, Agent, or Firm*—Thomas A. Lennox

[57] ABSTRACT

A holder and dispenser of cable wire such as ROMEX is provided to hang from rafters or joists whether or not the flooring or roof have been laid. The dispenser includes a cable reel holding frame, a swivel such that the frame rotates to the direction the cable is pulled from the reel, a vertical telescoping strap support on which the swivel and frame hang and a rafter and joist attachment means including an inverted U-shape to hang over the top of rafters or joists and an upright U-shape to attach from below together with hand screw devices to secure the attachment.

10 Claims, 8 Drawing Figures

CABLE HOLDER AND DISPENSER

BACKGROUND OF THE INVENTION

This invention relates to a holding and dispensing device for electrical cable which is installed to carry electricity in building structures. The cable construction generally includes a sheath covering two electricity carrying copper strands plus a ground wire. For most constructions, the sheath is a non-metallic plastic covering such as for the commonly used ROMEX cable. For some building codes, particularly for certain industrial installations, metallic sheathed cable, generally known as BX cable is used. For the purposes of this specification the term "cable" is intended to include all such types of electrical cable and wherever the trademark ROMEX is used, it is intended that the other types of cable may be used interchangeably. The device of this invention is intended to hold a cable and dispense it in a fashion convenient and useful for electricians working within the building structure to install the electrical wiring system.

Most electrical wiring for houses, buildings and like structures is installed in buildings before they are completed. Typically, the building contractor will have laid the foundation, raised the studs, joists and rafters, covered it with a roof and siding, but will not have completed the flooring or the interior paneling, ceilings, plastering and the like. Therefore, as the electrical contractor or electrician arrives to install the cable from junction box to junction box to switch and finally to the circuit breaker or fuse box and the main line, the exterior of the house or structure has been completed, but the interior is in a rough condition. Joists and rafters are exposed and depending upon a variety of factors, the floor or ceiling above the joists will sometimes be covering it or it may be open or partially open. Therefore, the joists or rafters may have the tops exposed or they may be covered completely without the control of the electrician or electrical contractor.

The cable is generally available and is purchased in a variety of packaging forms. While reels of wire are available containing 500 to 1,000 feet of cable, no satisfactory handling and dispensing device is available so that ROMEX cable is typically purchased in 250 feet lengths rolled in boxes. It is not practical or feasible to use the wire by merely pulling it from the box as it will snag and become entangled causing great inefficiency and delay. As a result, a common practice is for the electrician to carefully uncoil the wire from the box and lay it across the floor in 30 foot lengths back and forth until the box is emptied. In this fashion, the cable is criss-crossed across the floor and used until that length is gone or until the job is completed wherein the wire must be folded up and carried to the new job. Since the box contains only 250 feet there is a stub end lost and discarded for each box. This entire process is inefficient, is a safety hazard, requires extra time and results in a significant loss of material.

ROMEX cable is also available on reels containing at least 500 feet and typically 1,000 feet of cable. The reels vary in shape ranging in sizes 20 inches to 27 inches in diameter and twelve inches to about 17 inches in length. A one inch to three inch hole the length of the reel is provided to hang and store the reel.

Reel holders for use on the job are available. These generally consist of a low platform with adjustable rollers between which the reel is placed. As the wire is unrolled, the reel turns on the rollers not unlike a roller mill construction. This system is undirectional and as the reel empties, it is pulled off the holder and rolls toward the electrician off the roller causing an interruption in the work. At that time it is necessary to unroll the wire from the reel and use the method described above to handle the cable. Typically, the electrician is forced to carry the reel from place to place throughout the building and constantly move the reel position within the room so that it is available to be threaded the various wood or metal components of the structure.

Because of the lost time in handling the boxes or of the cable there is a great need to provide some sort of dispensing device which will be convenient for the electrician, allow more than one electrician to use the same reel, prevent snarling and have the reel available as the electrician moves from place to place within the structure.

It is therefore an object of this invention to provide a reel holder that will receive the rolls and suspend them off the ground or the floor where the electrician is working.

It is an additional object of this invention to provide a reel holder that will feed the wire in the direction in which it is pulled without causing the holder to jam or drop the reel.

It is an additional object of this invention to provide a reel holder that can be adjusted to varying heights depending upon the height of the ceiling or the roof and hold the reel at the level where the electrician is installing the cable.

It is an additional object of this invention to provide a reel holder that will attach to the exposed rafters and joists used in the construction of buildings and exposed at the time the electrician is installing the cable.

It is an additional object of this invention to provide a cable holder which will hang over exposed joists or rafters before the flooring or roofing is installed but also have the capability of attaching to the rafters or joists after the flooring or roofing has been installed on top of the rafters or joists.

It is an additional object to provide a cable dispenser which provides a safe, quick and efficient way of dispensing cable without the necessity of removing it from the reels.

DESCRIPTION OF THE PRIOR ART

A number of patents have been obtained disclosing cable holders and dispensers, most all of which have contemplated dispensing the wire from a coil which is piled vertically. These include U.S. Pat. No. 3,017,136 to Noffke which discloses an unreeler to unwind rolls of electrician wire; U.S. Pat. No. 3,729,092 to Marcell which discloses a support to unwind coiled wire, U.S. Pat. No. 3,778,000 to Bruener et al which discloses a rotatable reel for storing a coil of wire, again in the vertical position and U.S. Pat. No. 3,837,597 to Bourhenne which discloses a coiled cable dispenser. All of these patents provide for the coil to be supported vertically and do not include embodiments of the present invention.

U.S. Pat. No. 3,696,697 to Hoffman discloses a dispenser for a reel filament material such as solder which is hung from the belt with the reel supported in a horizontal position. In the same fashion U.S. Pat. No. 3,279,720 to Garrett discloses a hanger bracket for solder spools. Other line carrying reels, all holding the cylindrical reel in a vertical position include U.S. Pat.

No. 1,896,741 to Crandall, U.S. Pat. No. 1,908,073 to Spoor et al and U.S. Pat. No. 2,630,980 to Weaver. All of these patents relate to devices substantially different to that disclosed hereinbelow and none will provide the advantages and satisfy the objects listed hereinabove. All of the devices directed to use with cable do not use reels and contemplate removing the cable from the container and rewinding or placing it in the device.

SUMMARY OF THE INVENTION

My invention is directed to a holder and dispenser of cable wires while still on the standard reels which includes an axle held in a frame of sufficient size and strength to hold the reel through the center hole provided therein, a swivel mechanism from which the frame hangs allowing it to turn and rotate horizontally in the direction the cable is pulled from the reel, a vertical strap support, which will generally be provided to telescope to various lengths to allow the reel to hang from a rafter or joist at the work level, and an attachment and hanging device which allows the holder and dispenser to attach to and hang from a rafter or joist of a house or structure under construction. This attachment device comprises two shapes the elements of each of which can be combined to be the elements of the other shape. The shapes include an inverted U-shape sufficient to extend downwardly over the outside of a rafter or joist and a second shape of an upright U of sufficient size to slide around the bottom and up the side of a rafter or joist with at least one threaded hole in one of the vertical uprights of the U-shape and a hand screw which is threaded into the hole.

DESCRIPTION OF PREFERRED EMBODIMENTS

Figure 1:
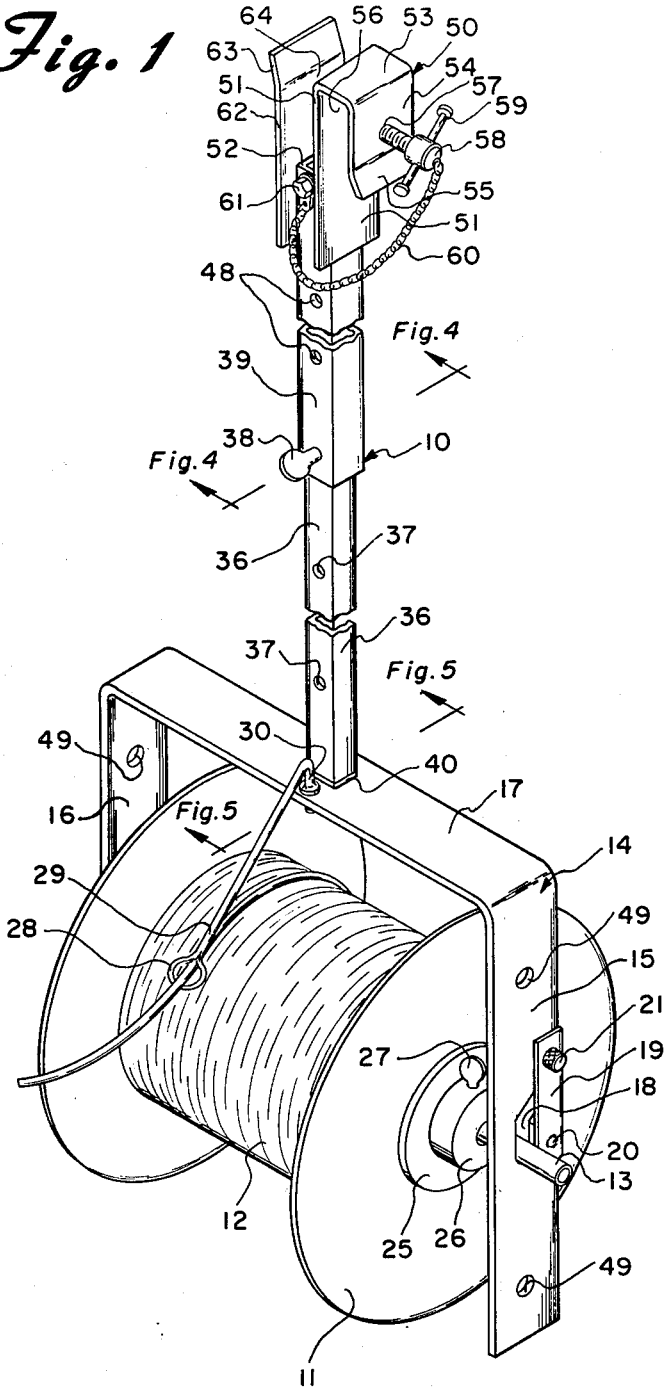
FIG. 1 is a perspective view of the holder and dispenser of this invention with a reel of cable shown in the holder of the dispenser.
Figure 6:
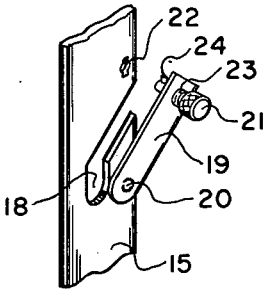
FIG. 6 is an expanded perspective view of the lock mechanism to hold the axle in position when the reel is in the holder.

In FIG. 1, holder and dispenser 10 of this invention is shown in a perspective drawing. Reel 11 containing ROMEX cable 12 is shown held in holder and dispenser 10. Reel 11 is twelve inches long with a diameter of approximately twenty inches with a cylindrical aperature in the center the length of the reel with a diameter of about one and one-half inches. Reel 11 is allowed to rotate on pipe 13 which is standard one inch outside diameter aluminum pipe. Frame 14 is constructed of a single strip of aluminum three-eights inch thick and 4 inches wide. Frame 14 is formed in an inverted U-shape to form vertical straps 15 and 16 leaving horizontal support 18 to connect to the upper portions of dispenser 10. Slot 18 is cut into vertical strap 15 to allow pipe 13 to be placed in slot 18 and rest in place while in use. Lock strap 19 rotates on pin 20 and is shown in the locked position through knob 21. In the expanded view of FIG. 6, lock strap 19 is rotated on pin 20 to the lock position, knob 21 is pulled on extending spring 23 and allowing locking pin 24 to avoid strap 15 and be inserted in aperature 22 thus locking pipe 13 in position. Identical locking apparatus is provided for vertical strap 16 hidden in FIG. 1 behind reel 11.

The length of vertical support 17 is chosen to provide space for standard size reels up to a length of about 18 inches. With the smaller reels, it is helpful to keep the reel in the center of pipe 13 and at the same time prevent pipe 13 from falling out of slot 17 or its counterpart slot 17' on vertical strap 16. Washer 25 and spacer holder 26, a ring of cast aluminum, is held in position on pipe 13 with thumb screw 27. Identical parts 25', 26' and 27' are provided on the other side of reel 11 to carry out an identical function on that side of the reel as shown on FIG. 7.

Figure 5:
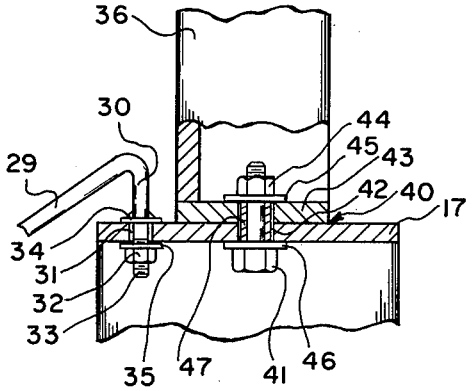
FIG. 5 is a partial cross-sectional view taken along Line 5—5 of FIG. 1 showing the swivel construction and the guide attachment construction.

As the end of ROMEX cable 12 is drawn off reel 11, it is threaded through guide eye 28, a steel loop connected through steel rod 29 angled downwardly from vertical rod 30 which is swivelly attached to horizontal support 17 as further illustrated in FIG. 5. Vertical rod 30 extends through hole 31 in horizontal support 17 being held in position by bolt 32 on threaded end 33. Washers 34 and 35 allow rod 30 and thus eye 28 to rotate horizontally to guide the ROMEX cable and prevent snarling and back-lash. Although natural resistance prevents rod 29 from traveling too far, stops can be provided to prevent the wire from passing over the ends of reel 11.

Frame 14 is connected through a hole in horizontal support 17 to lower vertical strap support 36 by means of a swiveling attachment as further illustrated in the partial cross-sectional view of FIG. 5. Lower vertical strap support 36 is constructed of a U-shaped beam of extruded aluminum having three-sixteenth inch wall thickness with an outside dimensions of one-fourth inches width and depth. In FIG. 1, support 36 is shown cut off but is actually about three feet in length and has a plurality of one-half inch threaded holes spaced at regular intervals to receive from screw 38 which connects it to upper vertical support 39.

Swivel attachment 40 includes a bolt 41 which passes through hole 42 in horizontal support 17 and in end 43 of lower vertical support 36, the later which is arc welded to the U-shape support 36. Bolt 41 is held in position by nut 44 which is tightened securely against washer 45 which along with washer 46 is tightened against brass sleeve 47 which allows bottom 43 and support 17 to swivel horizontally at swivel point 40.

Figure 4:
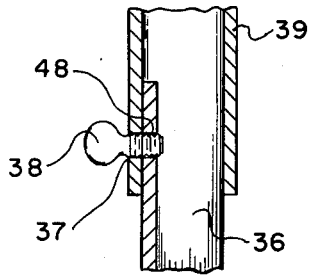
FIG. 4 is a cross-sectional view across Line 4—4 of FIG. 1 showing the connection between the telescoping portions of the strap support.

Upper vertical strap support 39 is a three foot length of box shape aluminum with a wall thickness of three-sixteenths inch and outside square dimension of one and five-eighth inches to allow lower support 36 to telescope essentially its full length of over three feet. A plurality of holes 48 identical in size and threading to holes 37 are spaced along support 39 for rigid inter connection with support 36 as shown in the partial cross-sectional view in FIG. 4.

A series of four - one inch holes 49 in vertical straps 15 and 16 (one hole 49 is hidden in FIG. 1) provide added versatility to the use of dispenser 10. Two extra one-inch pipes may be inserted and with pipe 13 can each hold three or four spools of single strand wire handling up to twelve spools for special wiring jobs.

The joist and rafter attachment system is rigidly connected through arc welding to the upper end of support 39. Hook connector 50 is of sufficient size to hook over and snugly fit over typical wooden joints and rafters including standard 2 × 4's 2 × 6's, 2 × 8's, 2 × 10's, 2 × 12's and the like. The width of a standard two inch board is about one and five-eights inches and is preferred that the inside dimension of hook 50 be sufficient to fit snugly over a one and five-eights inch joist or rafter. Hook 50 is constructed of a single sheet of case hardened aluminum sheet three-eights inch thick and five inches wide. Vertical member 51 of hook 50 is welded to support 39 and extends above end 52 of support 39 about eight inches. Hook 50 extends as horizontal member 53 and then bends downwardly as outside vertical member 54 approximately eight inches. End 55 angles outwardly to easily receive the rafter or joist which snugly fits in inside space 56 of hook 50. Hole 57 is threaded to receive five-eighth inch hand screw 58 through which sliding rod 59 passes to provide additional torque. Hand screw 58 is attached to support 39 through chain 60 connected through bolt 61. As will be apparent additional hand screws are preferably included while the size of hook 50 fits over standard two inch lumber it may be constructed to also fit over standard three inch lumber.

A second part of joist and rafter attachment system is vertical member 62 which is rigidly arc welded to the end of support 39 and is constructed of a single sheet of case hardened aluminum three-eights inch thick and five inches wide. Member 62 preferably extends above end 52 at least eight inches with end 63 formed slightly outwardly to easily receive joists or rafters which snugly fit in channel 64 formed by member 62, end 52, and vertical member 51. Channel 64 in this embodiment is approximately one and five-eighths inch wide so as to easily slip over standard two inch joists and rafters from below. This dimension can be adjusted during construction by adding a shim between upper support 39 and member 62 to allow it to receive standard three inch joists and rafters.

Figure 2:
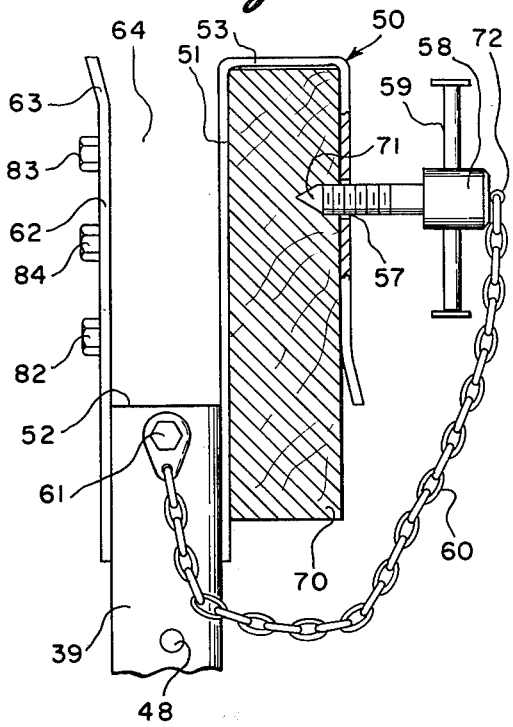
FIG. 2 is a side view, partially cut away, of the hanger portion of the holder and dispenser shown in FIG. 1 with a cross-section of a joist shown in position when the hanger is hung over the joist.

As illustrated in the side and partial cross-sectional view in FIG. 2, the joist and rafter attachment system is shown with hook 50 over a 2 × 10 to 2 × 12 joist. Joist 70 is shown with hook 50 hanging on it and being held in position with hand screw 58 threaded through hole 57 with point 71 forced into rafter 70 by torque placed on rod 59. Hole 57 is located about two inches from horizontal extension 53 to allow it to meet and imbed into 2 × 4's or even 2 × 3 joists. Hand screw 58 is attached to upper support 39 by chain 60 through ring 72 and through bolt 61 which is tightened into a threaded hole in support 39. Although the length of the threaded portion of hand screw 58 in the illustration is shown relatively short, it is preferred that it be at least two inches long so that it can serve a dual purpose on the other side of the joist and rafter attachment system as described below.

Figure 3:
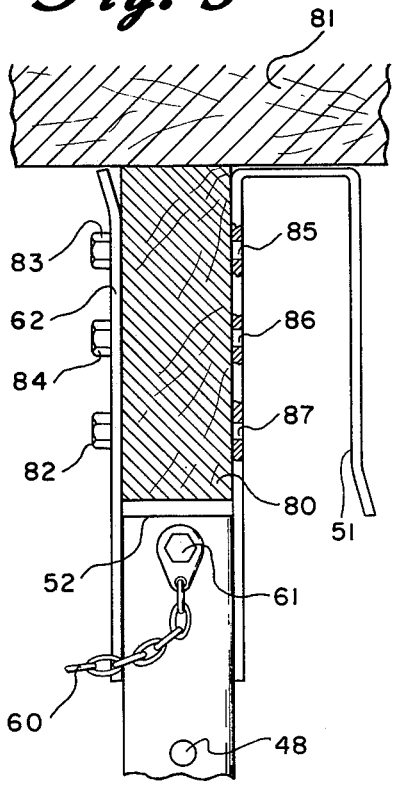
FIG. 3 is a side view, partially cut away, of the same hanger portion pictured in FIG. 2 wherein the hanger is attached to a joist from below.

In FIG. 3 a side view of the joist and rafter attachment system is provided wherein joist 80 is a standard 2 × 8 over which flooring 81 has been laid so that hook 50 cannot be used to hang dispenser 10. As a result, the second method of attachment is used wherein the U-shape formed by vertical member 62, end 52 and vertical member 51 is slid over joist 80. In this attachment method, hand screw 58 is critical to holding dispenser 10 in position and is threaded through five-eighth nut 82 arc welded over a hole in vertical support 62. Nut 82 is located about one and one-half inches above end 52 so that hand screw 58 (not shown in this figure) attached to chain 60 can be imbedded in joist 80 and is in a suitable position to imbed a joist as small as a 2 × 8.

A second five-eighth inch nut 83 is welded over a suitable hole about one and one-half inches from the top of vertical support 62. In this position, a second hand screw which is preferably provided on a second chain, can be imbedded in a joist as small as a 2 × 3 or 2 × 4.

A third five-eighth inch nut 84 is provided at an intermediate distance for use in intermediate size joists and would be particularly useful for a 2 × 6.

For the utmost in safety, it is recommended that the electrician drill a one inch hole in the lower half of the joist or rafter and screw hand screw 58 into that hole. When the attachment means are used in this fashion, the hand screw will normally be threaded into nut 83 which will provide more than enough space to receive up to a 2 × 4 joist. It is contemplated that the threaded portion of screw 58 is long enough to extend entirely through the joist and into threaded holes 84, 85 and 86 although threading through holes is not necessary for full attachment.

Figure 7:
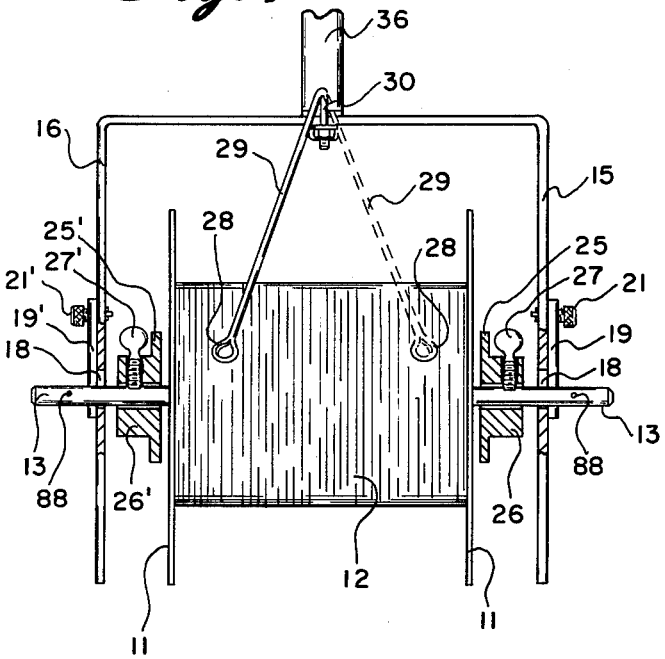
FIG. 7 is a side view and partial cross-section of the reel holding device and guides.

A partial cross-sectional view of the reel holder system and guide from FIG. 1 is pictured in FIG. 7. In this view, reel 11 partially filled with cable 12 is shown rotating on pipe 13 which extends through and is held by vertical straps 15 and 16. Lock straps 19 and 19' are locked in position to prevent pipe 13 from being moved. As reel 11 is one of the smaller sizes, washer 25 and spacer 26 held in position on pipe 13 with thumb screw 27 is used on the right, along with washer 25', spacer 26' held in position with thumb screw 27' on the left. Guide 28 is shown at a suitable vertical level although this may be adjusted upperwardly or downwardly by adjusting the length of vertical rod 30. As cable 12 is unreeled through eye 28, it will follow the cable position on reel 11 as shown in the shadow position to the right. In its natural swing of the arc, it will remain within the ends of reel 11. Transverse one-eighth inch holes 88 through both sides of pipe 13 are provided on both ends of pipe 13, when needed, common nails or pins may be inserted to prevent pipe 13 from sliding out of grooves 18 and 18'.

Figure 8:
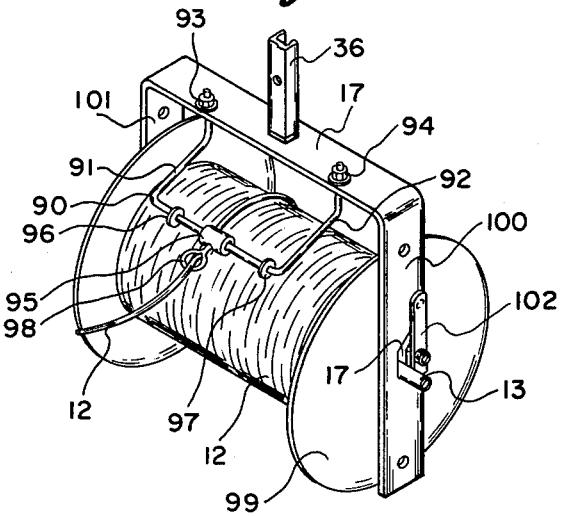
FIG. 8 is a perspective view of a preferred embodiment of a holder of the device pictured in FIG. 1.

In a preferred embodiment shown in FIG. 8, an alternative guide system is utilized. In this construction, horizontal rod 90 is held at approximately the same vertical height as eye 28 shown in FIG. 7. Rod 90 is rigidly attached through arms 91 and 92 through threaded ends and nuts 93 and 94 through horizontal support 17 which in turn is swivelly attached to lower vertical support 36. Traveling along horizontal rod 90 between stops 96 and 97. Eye 98 extends from sleeve 95 through which the end of ROMEX cable 12 passes through and is guided thereby.

In the embodiment pictured in FIG. 8, reel 99 is approximately 17 inches in length so that the spacer system 25, 26 and 27 and spacer system 25', 26' and 27' are not necessary. In this embodiment, lock mechanism 102 is shown extending from the top and locking below slot 17.

It is preferred that the upright U-shape fitting over the bottom of the joist or rafter and the inverted U-shape hook to fit over the top of the rafter or joist be constructed such that the connected side of the hook shape be in a position and be of sufficient size to also be the inside vertical element of the upright U-shape. It is also preferred that there be at least one threaded hole in the outside vertically downward extension of the hook shape to allow connection with the rafter or joist with a hand screw. Obviously, this attachment is not necessary to prevent the dispenser from falling, but it is preferred to prevent it from sliding or moving during use. It is critical that there be at least one threaded hole in the outside vertical element of the upright U-shape and it is preferred that there be at least two threaded holes in that upright. It is more preferred that there be three holes in this vertical upright of the U-shape and that it be reinforced with threaded nuts.

It is preferable that there be transverse threaded holes through both sides of the upright U-shape to allow the hand screw to extend through a pre-drilled hole in the joint or rafter and thread through both sides of the upright U-shape through that hole.

While this invention has been described with reference to the specific embodiments disclosed herein, it is not confined to the details set forth and the patent is intended to include modifications and changes which may come within and extend from the following claims.

I claim:

1. A holder and dispenser of cable wire from reels comprising:

(a) a cable reel holding means comprising an axle held in a frame, (b) a swivel means from which the frame hangs allowing the holding means to rotate horizontally in the direction the cable is pulled from the reel, (c) a vertical strap support on which the swivel means hangs, and (d) a rafter and joist attachment means from which the vertical strap hangs comprising a U-shape inverted in the operative position of a size sufficient to hand over the top of a rafter or a joist, and an upright U-shape of sufficient size to slide over the bottom and sides of a joist or rafter from below with at least one hole in one of the vertical uprights of the upright U-shape and a pin means fitting into the hold capable of imbedding into the joist or rafter.

2. The holding and dispensing device of claim 1 wherein the frame comprises a horizontal member which is connected to the swivel means at its approximate center and two vertical arms extending downwardly from the ends of the horizontal member with holes located in each vertical arm to receive the ends of the axle.

3. The holding and dispensing device of claim 2 wherein two cylindrical guides are demountably attached to the axle one each between the reel and the inside of the vertical arms on that side.

4. The holding and dispensing device of claim 2 wherein a plurality of transverse holes are provided in the vertical arms to receive additional axles capable of holding a plurality of individual spools of wire on each axle.

5. The holding and dispensing device of claim 1 wherein transverse holes are provided through each end of the axle and a pin means insertable in each tansverse hole are provided to prevent the axle from falling out.

6. The holding and dispensing device of claim 1 wherein a cable guide means is provided to allow the cable to be uncoiled from the reel but prevent snarling over the ends of the reel comprising an extension means to hold a horizontal rod at approximate vertical height the wire is drawn off the reel, a cylindrical tube sliding on the horizontal rod, and a guide loop attached to the slide of a size through which the cable passes freely.

7. The holding and dispensing device of claim 1 wherein the vertical strap support is an adjustable telescoping vertical strap to allow the reel to be suspended at work level comprising a lower element connected to the swivel means, an upper element rigidly connected to the joist and rafter attachment means, and a detachable inter-connecting means to allow the lower element and upper element to be connected to form various lengths.

8. The holding and dispensing device of claim 1 wherein the rafter and joist attachment means comprising an inverted U-shape of sufficient size to hang over standard size joists and rafters with a threaded hole through the outside unconnected vertical side of the U-shape with a hand screw in the threaded hole and, a U-shape member having a bottom and two vertical arms spaced apart to allow the U-shape to slide onto the joist or rafter from the bottom with at least one threaded hole through at least one vertical strap at a distance from the top so that a hand screw through the threaded hole will be imbed in the smallest of the standard size rafters or joists when the floor or ceiling has been affixed thus limiting the distance the U-shape may be slid over the rafter or joist.

9. The holding and dispensing device for claim 1 wherein the joist and rafter attachment means comprises an inverted U-shape with one of the vertical sides of the inverted U-shape rigidly connected to the vertical strap support and of sufficient size and shape to hang over standard size joists and rafters and, the attachment means further comprising a vertical member rigidly attached and extending from the top of the vertical strap support, which together with the connected vertical side of the inverted U-shape forms an upright U-shape; the upright U-shape being of sufficient size to allow it to slide onto a joist or rafter from the bottom and having at least one threaded hole through the vertical upright member at a distance from the top of that member that a hand screw through the threaded hole will imbed in standard size joists and rafters when the device is limited to sliding onto the rafter or joist above the top of that rafter or joist.

10. A holder and dispenser of cable wire from reels comprising:

(a) a frame consisting of a horizontal member and two vertical arms extending downwardly from the ends of the horizontal member with at least one pair of transverse holes in a horizontal plane through the two vertical arms, (b) at least one axle extending between and through the pair of holes to hold the reel and allow it to rotate on the axle, (c) a swivel means swivelly connected to the horizontal member at its approximate center allowing the frame to swivel in the direction the cable is pulled from the reel, (d) a vertical strap support comprising a lower vertical support member connected to the swivel means, an upper vertical support member, wherein the upper and lower strap support members telescope together to provide varying lengths, and inter-connecting means to allow the lower and upper strap supports to be rigidly and detachably inter-connected to form various lengths and, (e) a joist and rafter attachment means comprising an inverted U-shape with one of the vertical sides of the inverted U-shape rigidly connected to the vertical strap support and of sufficient size and shape to hang over standard size joists and rafters and, the attachment means further comprising a vertical member rigidly attached and extending from the top of the vertical strap support, which together with the connected vertical side of the inverted U-shape forms an upright U-shape; the upright U-shape being of sufficient size to allow it to slide onto a joist or rafter from the bottom and having at least one threaded hole through the vertical upright member at a distance from the top of that member that a hand screw through the threaded hole will imbed in standard size joists and rafters when the device is limited to siding onto the rafter or joist above the top of that rafter or joist.

* * * * *